United States Patent [19]

Goedert

[11] 4,347,078

[45] Aug. 31, 1982

[54] PROCESS AND APPARATUS FOR THE DESULFURIZING OF IRON MELTS

[75] Inventor: Jean Goedert, Esch, Luxembourg

[73] Assignee: Arbed S.A., Luxembourg, Luxembourg

[21] Appl. No.: 106,367

[22] Filed: Dec. 21, 1979

[30] Foreign Application Priority Data

Dec. 21, 1978 [LU] Luxembourg ..... 80692

[51] Int. Cl.[3] ..... C21C 7/00

[52] U.S. Cl. ..... 75/51; 75/52; 75/53; 75/58

[58] Field of Search ..... 75/51, 52, 53, 58

[56] References Cited

U.S. PATENT DOCUMENTS 3,929,464 12/1975 Todd ..... 75/58
3,955,966 5/1976 Meichsner ..... 75/58
3,998,625 12/1976 Koros ..... 75/58

*Primary Examiner*—P. D. Rosenberg
*Attorney, Agent, or Firm*—Michael J. Striker

[57] ABSTRACT

A desulphurizing agent is blown into a metallurgical converter from a storage bin which is connected over a vane type bilowthrough feeder. Variable amounts of desulphurizing agents are fed through the inlet by margin the rotational speed of the vanes.

5 Claims, 4 Drawing Figures

PROCESS AND APPARATUS FOR THE DESULFURIZING OF IRON MELTS

BACKGROUND OF THE INVENTION

The present invention relates to a process and an apparatus for the desulfurizing of iron melts.

It has been known for decades how to desulfurize by adding, with the aid of suitable device, substances which are capable of forming compounds with the sulfur contained in the melts at high temperatures and under reducing conditions, these compounds then settling in the slag layer which is present above the melts. Such substances are, for instance, CaSi, $CaC_2$, or mixtures of CaO and $CaF_2$.

It has been found that the known desulfurizing processes allow desulfurizing an iron melt containing about 0.025% S, down to 0.012% S, i.e. to reduce the sulfur content by half. This halving of the sulfur content by means of conventional processes can, however, not be achieved when the initial sulfur content is already of the order of about 0.015%.

Conditions are such that the desulfurizing quotient (% S initial/% S final) will drop with the lower initial sulfur content, and that, with the known processes, an initial sulfur content of about 0.015% S can be reduced only to about 0.010%. It is to be noted herein that this cannot be considered a satisfactory result, also not in respect of the desulfurizing effectiveness (% S removed/kg desulfurizing agent).

It is to be emphasized at the same time that desulfurized contents of 0.010% S that can be achieved from an initial 0.015% S by means of conventional processes, will not satisfy the metallurgist in view of the demands for ever lower sulfur contents in the steel.

SUMMARY OF THE INVENTION

The object of the invention thus consists in proposing a process and an apparatus for the desulfurizing of iron melts, which will allow a greater desulfurizing effect than with conventional processes, particularly in the case of relatively low initial sulfur contents.

This object is attained with a process which provides for treatment of an iron melt in a metallurgical vessel by a desulfurizing agent blown in by a propellant gas through a lance located close to the bottom, this in such a manner that a sufficiently high constant pressure of the propellant gas is maintained at the lance, and by maintaining a continuous feed of the propellant gas flow with the desulfurizing agent which is added by a mechanical feeding device with infinitely variable throughput, and furthermore by supplying during the process an additional flow of gas through the vessel bottom into the melt.

The idea on which the process as per invention is based, proceeds from the fact that with relatively lower initial concentrations of sulfur, and even more so after desulfurizing has advanced, the probability of sulfur coming into reaction with the desulfurizing agent will increasingly diminish. As per invention, this is counteracted by adding the desulfurizing agent in constant quantities and over a longer period, during which the possibility of a reaction continues to exist, and, by concomitantly achieving the best possible distribution of the desulfurizing agent within the melt when the latter is being agitated.

To succeed with the process as per invention, there are, furthermore, various preconditions, as known per se, that must be satisfied. It is for instance necessary to provide the metallurgical vessel with a basic lining, to deslag prior to the beginning of the treatment, and also to take care that the iron melt has been desoxidized to a high degree.

It is essential that the desulfurizing agent, preferably present in the form of fine granules, can be introduced into the metallurgical vessel without problems and by means of a lance close to the bottom.

It has been known how to entrain solids into a gas flow by using a so-called vane type feeder, interposed between the storage bin for the additive and the lance used for blowing.

Similar feeders, in which the additive is fluidized to facilitate entering into the lance, are described for instance in the D Publication of Specification Nos. 1.292.693 and DT Letters Patent No. 2.303.978.

The disadvantages of apparatus within which the solid additive is fluidized in order to loosen it up and to facilitate introduction into the lance, consist mainly in the fact that fluidizing equipment is complicated, defect prone, and thus also costly, and also in the fact that the entire quantity of the additive to be used must be fluidized over the entire period of treatment, and by the need to compensate interaction between fluidizing chambers and, respectively, the feeding and discharge lines, which makes control of the throughput of additive difficult.

DESCRIPTION OF THE PREFERRED EMBODIMENT

The apparatus required for the implementation of the process as per invention, comprises in essence a storage bin pressurized by argon and containing the desulfurizing agent, which is connected over a van type blow through feeder with a pressurized argon feed line and an argon-solids discharge line which ends in a movable lance. The idea to substitute complicated fluidizing apparatus by a vane-type blow-through feeder, as known per se, for the entraining of the desulfurizing agent into the gas flow leading to the lance, will not only bring about an improved metallurgical utilization of the additive, but will also additionally allow a considerable decrease in the procurement and operating cost of blowing apparatus.

The apparatus as per invention is additionally distinguished by its simple construction and by being less defect prone.

As per invention, the vane type blow-through feeder is provided with an infinitely variable drive. The latter will enable a nearly ideal control of the throughput of the desulfurizing agent, accomplished simply by adjusting the rotational speed of the vane type rotor without any change occurring in the pressure conditions.

The above will furthermore enable treating the iron melt by blowing under constant pressure, which is desired with this type of treatment.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
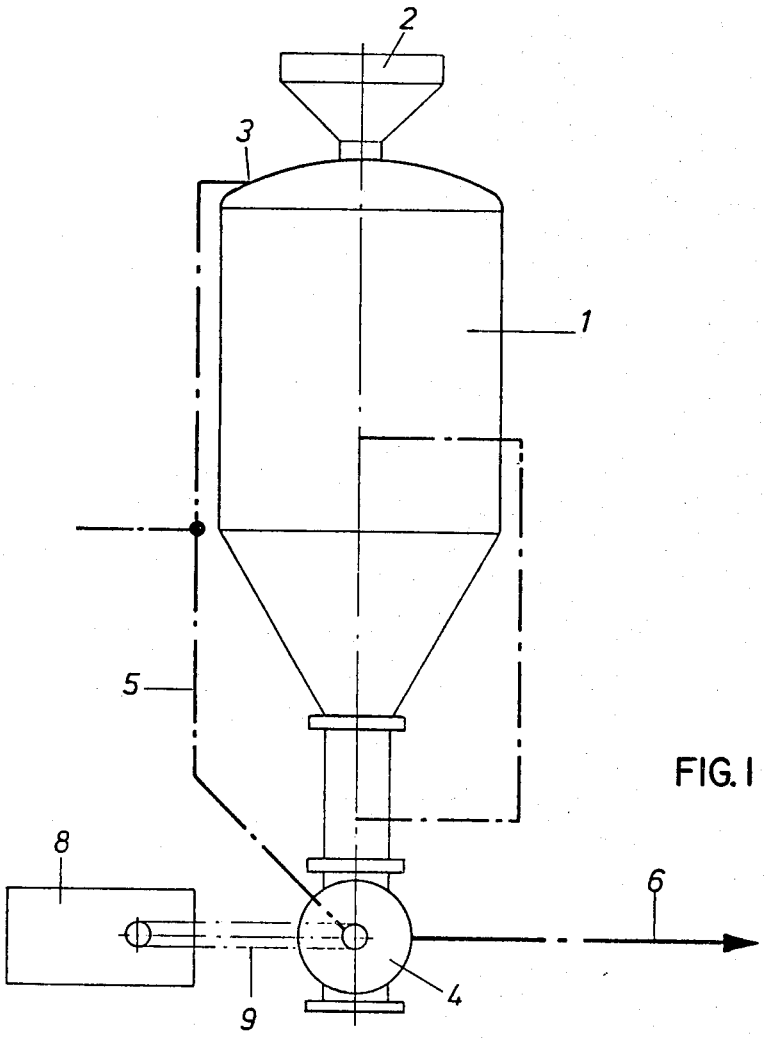

Shown in:

FIG. 1, a schematic front and

FIG. 2*a* top view of a preferred embodiment of the apparatus, and

Figure 4:
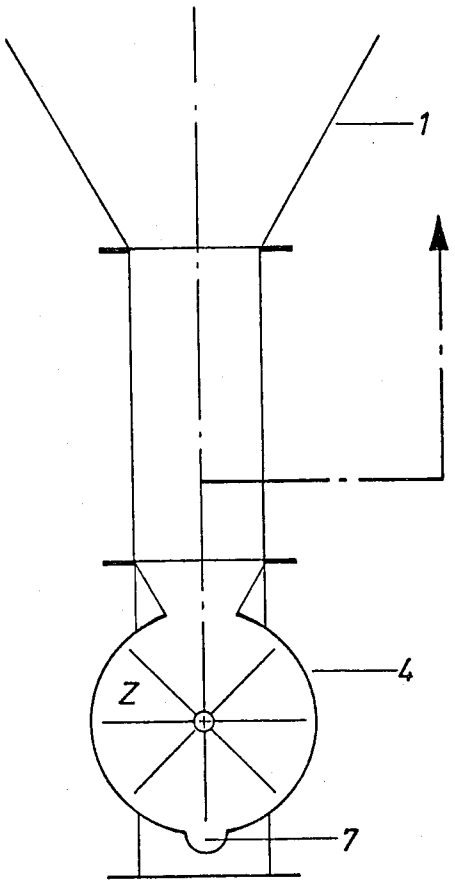
Figure 3:
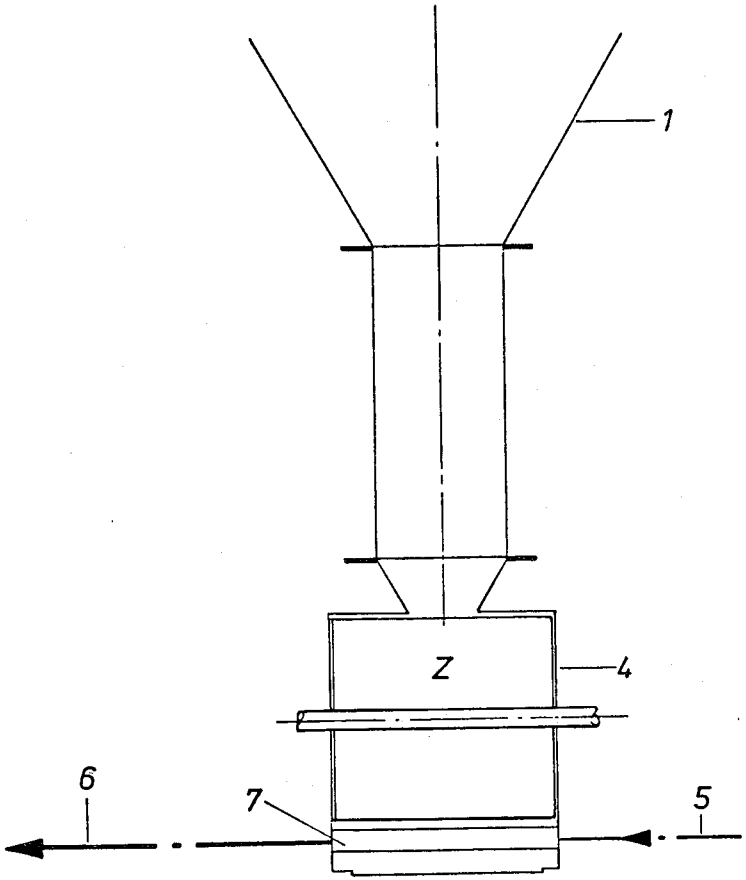

FIG. 3 and FIG. 4, two sections, offset by 90 degrees, through a vane type blow through feeder.

Figure 2:
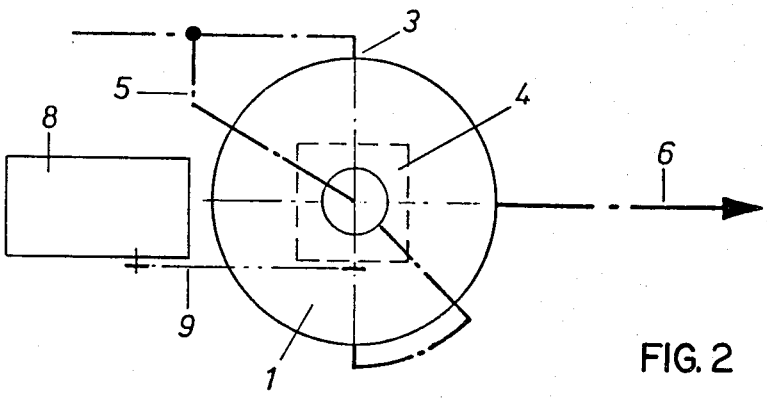

In FIG. 1 and FIG. 2, the storage bin (1) with the hopper (2) for the desulfurizing agent, and the upper argon feed (3) can be seen. The storage bin (1), is connected through the vane type blow through feeder (4) in which the argon feed line (5) ends, with the argon-solids discharge line (6), leading to the lance, not shown. An infinitely variable motor (8) serves for driving the rotor of the blow through feeder (4).

The vane type blow through feeder (4) shown in FIG. 3 and FIG. 4 comprises the vane rotor proper (Z). The desulfurizing agent stored in the storage bin (1) under argon, drops into the vane type feeder. After rotation of the vane rotor (Z) by 180°, the material will reach the passage (7) in which the argon, supplied through the pressure line (5) will entrain it into the pressure line (6) and feed it to the lance.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

1. In a method for the desulfurizing of iron melts of the type in which an iron melt in a metallurgical vessel is treated with a desulfurizing agent blown in by means of a propellant through inlet means, the improvement comprising providing a storage bin that is connected over a vane type blowthrough feeder and gas propellant means with said inlet means; maintaining within said inlet means a gas propellant pressure higher than the counteracting ferrostatic pressure; and continuously feeding variable quantities of a desulfurizing agent through said inlet means by varying the rotational speed of the vanes in a vane type blowthrough feeder, without having to vary said propellant pressure.

2. Method according to claim 1, wherein said providing a storage bin comprises providing a storage bin that is connected over an infinitely variable drive vane type blowthrough feeder and gas propellant means with said inlet means.

3. Method according to claim 1, further comprising providing discharge means for said vessel.

4. Method according to claim 3, wherein said providing discharge means comprises providing a discharge line with a movable discharge end for said vessel.

5. Method according to claim 4, wherein said providing a discharge line comprises providing a discharge line with a movable lance for said vessel.

* * * * *